United States Patent [19]

Lantagne et al.

[11] Patent Number: 5,012,209

[45] Date of Patent: Apr. 30, 1991

[54] BROADBAND STRIPLINE COUPLER

[75] Inventors: John A. Lantagne, Salem, N.H.; Edward G. Johnson, Woburn; Michael J. Virostko, Townsend, both of Mass.

[73] Assignee: Raytheon Company, Lexington, Mass.

[21] Appl. No.: 464,066

[22] Filed: Jan. 12, 1990

[51] Int. Cl.[5] ..... H01P 5/18

[52] U.S. Cl. ..... 333/116; 333/238

[58] Field of Search ..... 333/116

[56] References Cited

U.S. PATENT DOCUMENTS

| | | | |
|---|---|---|---|
| 2,913,686 | 11/1959 | Fubini et al. | 333/238 |
| 3,093,805 | 6/1963 | Osifchin et al. | 333/238 X |
| 3,581,243 | 5/1971 | Alford | 333/116 |
| 3,768,042 | 10/1973 | Friend et al. | 333/116 |

FOREIGN PATENT DOCUMENTS

| | | | |
|---|---|---|---|
| 158702 | 12/1980 | Japan | 333/116 |
| 114302 | 5/1987 | Japan | 333/116 |

OTHER PUBLICATIONS

Microwave Filters, Impedance-Matching Networks, and Coupling Structures; G. Matthaei, L. Young; E.M.T. Jones Artech House, Inc., Dedham, Mass., 1964; pp. 789-792.

Stripline Circuit Design; Harlan Howe, Jr.; Artech House, Inc., Dedham, Mass., 1974; pp. 159-162.

"Shielded Coupled-Strip Transmission Line", S. B. Cohn, IRE Transactions—Microwave Theory and Techniques, Oct., 1955.

*Primary Examiner*—Paul Gensler

*Attorney, Agent, or Firm*—Donald F. Mofford; Richard M. Sharkansky

[57] ABSTRACT

Microwave apparatus fabricated in stripline is shown to be made up of (a) printed circuitry to form a directional coupler on both sides of a sheet of a dielectric material effectively suspended in space between a pair of ground planes, the printed circuitry being connected by shorting posts passing through the dielectric material; and (b) a matching section, formed from a dielectric material having a dielectric constant greater than unity, overlying portions of the printed circuitry.

13 Claims, 2 Drawing Sheets

BROADBAND STRIPLINE COUPLER

BACKGROUND OF THE INVENTION

This invention pertains generally to directional couplers used in microwave circuitry, and particularly to directional couplers fabricated in suspended stripline and adapted for use over extremely broad frequency bands.

It is known in the art that directional couplers fabricated in stripline (sometimes referred to hereinafter as "stripline couplers") may be used in many applications in microwave circuitry. For example, when low loss and constant dielectric properties are of paramount importance, a so-called suspended stripline coupler may be used to advantage. Such a coupler differs from a conventional stripline coupler in that a suspended stripline coupler comprises a printed circuit of appropriate shape supported (without a solid spacer having a dielectric constant greater than unity) between two opposing ground planes. The absence of a solid dielectric material reduces, as compared with a conventional stripline coupler, the susceptibleness of a suspended stripline coupler to changes in insertion loss and directivity when the frequency of an impressed microwave signal is changed.

unfortunately, a suspended stripline coupler fabricated in any known manner is satisfactorily operable on microwave energy only at a frequency that is within a relatively narrow band of frequencies encompassing a design frequency. However, many applications require satisfactory operation at any frequency within a relatively wide band of frequencies. For example, in a monopulse radar incorporating frequency diversity as a palliative against electronic countermeasures, it is necessary that a directional coupler operate satisfactorily over an extremely wide frequency band. Satisfactory operation, i.e., flat coupling over a broad frequency range, requires a multi-section coupler in which "even" and "odd" mode propagation of microwave energy occurs. An "even" mode of propagation means that an effective open circuit appears between the main and branch lines of a directional coupler. An "odd" mode means that an effective short circuit appears between the main and branch lines of a directional coupler. Because the cross section of supended stripline is not homogeneous, the phase velocity of propagation in the odd mode is less than that in the even mode, with the result that flat coupling and high directivity of known multi-section couplers may not be satisfactorily achieved throughout a wide band of frequencies. With the foregoing background in mind, it is a primary object of this invention to provide a directional coupler in stripline, such coupler being operable over a wide band of freqencies.

Another object of this invention is to provide a multi-section directional coupler in which the phase velocities of microwave energy propagated in either the odd or even mode of propagation are substantially the same throughout a wide band of operating frequencies.

The primary object of this invention, and others that will become evident, are attained generally by providing in a four-port suspended stripline coupler adapted to divide microwave power applied at a first port into unequal amounts at a second and third port, with substantially no power at a fourth port, such coupler being characterized by a matching arrangement to match the phase velocities within such coupler of microwave energy propagating in the odd and even modes.

BRIEF DESCRIPTION OF THE DRAWINGS

For a more complete understanding of this invention, reference is now made to the following description of the accompanying drawings in which.

DESCRIPTION OF THE PREFERRED EMBODIMENT

Figure 1:
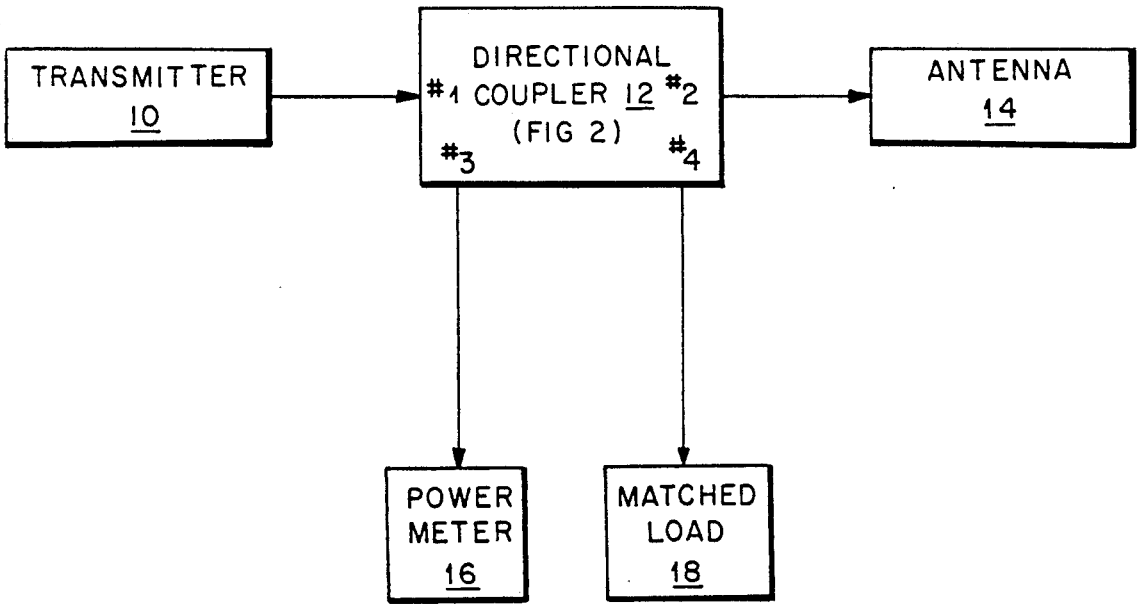
FIG. 1 is a sketch showing how the contemplated directional coupler may be incorporated in a system.

Referring now to FIG. 1, it may be seen that, in an exemplary application of the contemplated directional coupler, a small portion of microwave energy being transmitted may be sampled, thereby to permit monitoring of the level of the transmitted microwave energy. Thus, a transmitter 10 is connected to a first port (port #1) of a directional coupler 12, and an antenna 14 is connected to a second port (port #2) of such coupler. A power meter 16 and a matched load 18 are connected to the third and fourth ports (port #3 and port #4). The directional coupler 12 is operative in a known manner: (a) to pass the greater portion of microwave energy from the transmitter 10 to the antenna 14 and to pass the remaining portion of such energy to the power meter 16, and not to the matched load 18; and, (b) to pass any microwave energy traveling from the antenna 14 to the matched load 18 and to the transmitter 10, and not to the power meter 16.

As shown in Table I, the directivity, i.e., the degree to which a stripline coupler attains the just mentioned operational objects throughout a band of frequencies, is dependent upon the structural details of any stripline coupler. An acceptable figure for directivity is 20 dB. Thus, as shown in Table I, a conventional stripline coupler based on a design suggested by S.B. Cohn, in an article entitled "Shielded Coupled-Strip Transmission Line," publiched in Oct., 1955, in the IRE (Institute of Radio Engaineers) Transactions, MTT pages 29–38, is a relatively narrow band device. Similarly, a modified version of the conventional stripline coupler (which modification is accomplished simply by providing an air gap between the main line and the branch lines) is a relatively narrow band device. In contrast, the directivity of a stripline coupler, according to this invention is satisfactory throughout a frequency band having a width in the order of 18 gigahertz.

TABLE I

| | DIRECTIVITY (decibels, dB) | | |
|---|---|---|---|
| FREQUENCY (GIGAHERTZ) | CONVENTIONAL DESIGN | MODIFIED CONVENTIONAL DESIGN | INVENTION |
| 2 | 13 | 20 | 26 |
| 4 | 10 | 15 | 30 |
| 6 | 7 | 12 | 20 |
| 8 | 5 | 10 | 25 |
| 10 | 4 | 10 | 60 |
| 12 | 3 | 8 | 25 |
| 14 | 2 | 6 | 22 |
| 16 | 0 | 4 | 20 |
| 18 | 0 | 2 | 18 |
| 20 | 0 | 0 | 10 |

Figure 2:
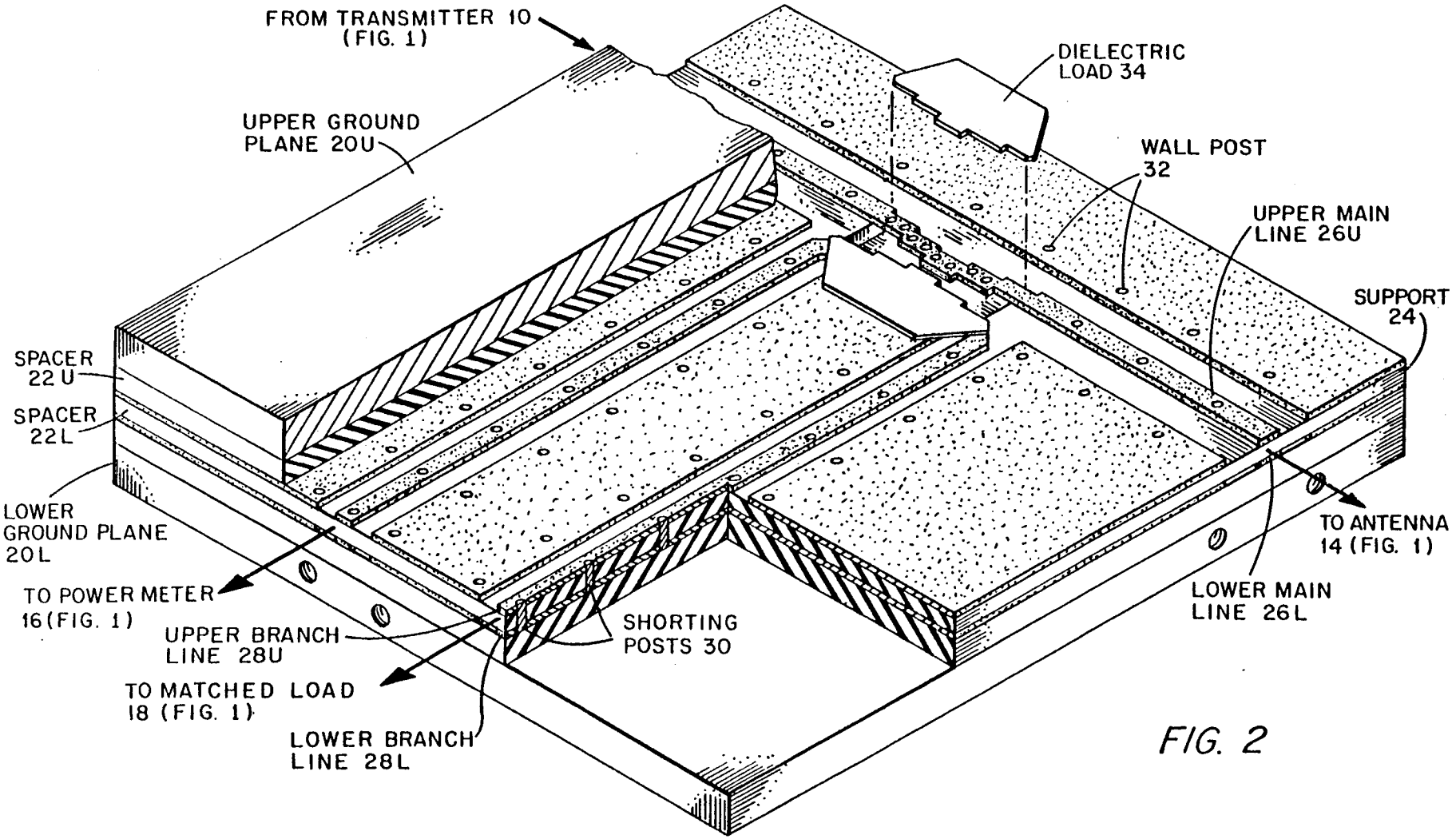
FIG. 2 is an isometric view, partially cut away and exploded, illustrating a preferred embodiment of the comtemplated directional coupler.

Referring now to FIG. 2, it may be seen that, for simplicity of illustration and clarity of explanation, elements not essential to an understanding of the invention have been omitted. For example, it will be apparent to one of skill in the art that appropriately configured connectors and transmission lines would be provided in a production model to permit use of the stripline coupler shown in FIG. 2 in a circuit such as the one shown in FIG. 1.

The stripline coupler is fabricated in stripline on a dielectric substrate between a first and a second ground plane, such coupler comprising circuitry forming a main line formed on the dielectric substrate and disposed between a first and a second port and a branch line formed on the dielectric substrate and disposed between a third and a fourth port, the main line and the branch line each including a coupling section formed on the dielectric substrate whereby a portion of any microwave energy applied to the first port appears at the second port. The improvement includes: (a) means for supporting the dielectric substrate and circuitry in position between the first and second ground planes, such means including dielectric material having a dielectric constant of unity overlying the main line and the branch line; and (b) a different sheet of dielectric material substantially overlying each coupling section, each such sheet being fabricated from a dielectric material having a dielectric constant greater than unity and a shape corresponding to the shape of the corresponding coupling section. Each coupling section is a multi-section coupler and the position of each different sheet of dielectric material relative to each coupling section is adjusted to equalize the phase velocities of microwave energy passing through each coupling section. The dielectric substrate is a sheet of dielectric material having a dielectric constant greater than unity, the circuitry being formed on oposite sides of the sheet, with electrically conductive posts passing through the sheet to connect the circuitry on the two sides of the sheet. More particularly as shown in FIG. 2, such coupler comprises printed circuitry (to be described) supported between an upper ground plane 20U and a lower ground plane 20L. Spacers 22U, 22L (formed from a closed cell polyimide foam material having a dielectric constant substantially equal to unity) are provided to position the printed circuitry between the upper ground plane 20U and the lower ground plane 20L. A satisfactory foam material is ROHACELL, manufactured by CYRO Industries of Orange, N.J. In effect then, the just described elements form a suspended stripline coupler because the printed circuitry is arranged to form a pair of directional couplers on opposing sides of a support 24. The dielectric constant of the material of support 24 is not critical and is typically greater than unity. The directional coupler comprises an upper main line 26U, and a lower main line 26L, each having a five-section coupler (not numbered). Further, the directional coupler comprises an upper branch line 28U and a lower branch line 28L, each also having a five-section coupler (not numbered). Via holes plated through the support 24 form shorting posts electrically connecting (as shown by shorting posts 30) the upper and lower branch lines 28U, 28L. Similarly formed shorting posts (not numbered) are provided to connect the upper and lower main lines 26U, 26L. Finally, wall defining posts, such as those designated wall posts 32, are formed, as shown by plating through via holes adjacent to the printed lines or by inserting electrically conductive pins through vias. The wall defining posts reduce leakage effects to a minimum in a known manner.

To complete the structure here contemplated dielectric loading is provided adjacent to each one of the five-section couplers. Such loading is effective to equalize the phase velocities of the microwave energy passing through the illustrated arrangement in both the odd and even modes of propagation. It has been here realized that: (a) the concentration of the electric field in the gap between the five-section couplers is greater for the odd mode of propagation than for the even mode; (b) the phase velocity of the even mode of propagation is greater than the phase velocity of the odd mode; and, (c) the difference between the phase velocities limits the band-width of a suspended stripline coupler. Therefore, if dielectric loading is effected in such a way as to slow down the phase velocity of microwave energy propagating in the even mode, more than the phase velocity of microwave energy propagating in the odd mode, changes in characteristics with changes in operating frequency may be minimized.

To accomplish the foregoing, a dielectric load (such as dielectric load 34) is disposed partially to overlap each one of the five-section couplers. As shown by dielectric load 34, each dielectric load is shaped so as to correspond with the steps in the printed circuitry making up each five-section coupler. The thickness of each dielectric load 34 is less than the spacing between the five-section couplers and the opposing ground planes 20U, 20L. Here the dielectric constant of the material of each dielectric load 34 is approximately 2.2. Such constant may, however, be varied. The position of each dielectric load relative to the associated five-section coupler may best be determined empirically to optimize the flatness of coupling over a relatively broad band of frequencies.

Having described a preferred embodiment of this invention, it will now be apparaent that changes may be made without departing from our inventive concept of providing dielectric loading in a suspended stripline coupler, such loading being effective to equalize the phase velocities of microwave energy in different modes of operation. For example, the number of sections in the coupler may be changed with a concomitant change in the shape of the dielectric load may be made. It is felt, therefore, that this invention should not be restricted to the disclosed embodiment, but rather should be limited only by the spirit and scope of the appended claims.

What is claimed is:

1. A directional coupler comprising:

(a) a first and a second ground plane;

(b) a dielectric substrate disposed between the first and second ground plane;

(c) circuitry, disposed on the dielectric substrate, having a main line with a main line coupling section having a shape and a branch line with a branch line coupling section having a shape to couple microwave energy from one line to the other line;

(d) means for supporting the dielectric substrate and circuitry in position between the first and second ground planes, such means including a first and a second sheet of dielectric material, each sheet having a dielectric constant of approximately unity and disposed between the dielectric substrate with the circuitry and a respective one of the first and second ground planes; and (e) a third and a fourth sheet of dielectric material, each one of the third and fourth sheets having a shape corresponding to the shape of a corresponding one of the main line and branch line coupling sections, the third sheet of dielectric material disposed between the main line coupling section and the first sheet of dielectric material, wherein the third sheet is disposed partially to overlap the main line coupling section to equalize phase velocities of microwave energy in both the odd and even modes of propagation passing through the main line coupling section, and the fourth sheet of dielectric material disposed between the branch line coupling section and the first sheet of dielectric material, wherein the fourth sheet is disposed partially to overlap the branch line coupling section to equalize phase velocities of microwave energy in both the odd and even mode of propagation passing through the branch line coupling section.

2. The directional coupler as recited in claim 1 wherein the dielectric substrate is a sheet of dielectric material having a dielectric constant greater than unity, the circuitry being formed on opposite sides of the sheet, with electrically conductive posts passing through the sheet to connect the circuitry on the two sides of the sheet.

3. A directional coupler comprising:

(a) a ground plane;

(b) a dielectric material;

(c) circuitry, such circuitry being separated from the ground plane by the dielectric material, the circuitry comprising:

(i) a main line conductor having a coupling edge portion;

(ii) a branch line conductor having a coupling edge portion facing the coupling edge portion of the main line conductor, such coupling edge portions being separated from each other in a coupling region of the coupler, the separation varying in distance over the coupling region; and (iii) a dielectric load associated with, and disposed adjacent, a portion of each one of the main line and branch line conductors, such dielectric load having an edge portion shaped to conform with the edge portion of the line conductor associated therewith and disposed to partially overlap the edge portion of the associated line conductor.

4. The directional coupler as recited in claim 3 wherein the coupling edge portion of an associated line conductor comprises a plurality of steps.

5. The directional coupler as recited in claim 4 wherein the plurality of steps progressively ascend and descend over the coupling region.

6. The directional coupler as recited in claim 5 wherein the plurality of steps form a portion of a multi-section coupler.

7. The directional coupler as recited in claim 6 wherein the portion of a multi-section coupler is a five-section coupler.

8. The directional coupler as recited in claim 3 wherein the dielectric material is a solid material.

9. The directional coupler as recited in claim 8 wherein the solid material has dielectric constant of approximately unity.

10. The directional coupler as recited in claim 9 wherein the dielectric load has a dielectric constant of approximately 2.2.

11. The directional coupler as recited in claim 10 further comprising conductive material, adjacent to, but not continuous to, the circuitry.

12. A directional coupler comprising:

(a) a first and a second ground plane;

(b) a pair of spacers disposed between the first and the second ground planes, each spacer having a closed cell polyamide foam material with a dielectric constant substantially equal to unity;

(c) a dielectric substrate having a first surface and a second surface with circuitry disposed on each surface, the dielectric substrate and circuitry disposed between the pair of spacers, the circuitry comprising:

(i) an upper main line and a lower main line disposed on the first surface and the second surface of the dielectric substrate respectively, each having a multi-section coupler, the upper and lower main line connected by via holes plated through the dielectric substrate; and (ii) an upper branch line and a lower branch line disposed on the first surface and the second surface of the dielectric substrate respectively, each having a multi-section coupler disposed juxtaposed a multi-section coupler of a corresponding main line to provide a gap, the gap between the multi-section couplers on the first surface and the second surface of the dielectric substrate providing a boundary of an area in the dielectric substrate having a void, the upper and lower branch lines connected by via holes plated through the dielectric substrate; and (d) means for reducing variation of concentration of an electric field in the gap between the multi-section couplers during odd and even mode of propagation and variation of phase velocity between the odd and even mode of propagation, the reducing means comprising: a plurality of dielectric loads, each dielectric load having a shape to correspond with a respective multi-section coupler and disposed adjacent to and partially to overlap the corresponding one of the multi-section couplers.

13. The directional coupler as recited in claim 12 wherein the multi-section coupler is a five-section coupler.

* * * * *